United States Patent [19]

Saito et al.

[11] 4,088,985

[45] May 9, 1978

[54] CENTRALIZED MONITORING SYSTEM FOR GAS LEAKAGE

[75] Inventors: Mitsuru Saito, Tokyo; Toshihide Nakamura; Shinichi Ogura, both of Niihama, all of Japan

[73] Assignees: Sumitomo Chemical Company, Limited, Osaka; Riken Keiki Fine Instrument Co., Ltd., Tokyo, both of Japan

[21] Appl. No.: 716,556

[22] Filed: Aug. 23, 1976

[30] Foreign Application Priority Data

Oct. 3, 1975 Japan ..... 50-120006

[51] Int. Cl.[2] ..... G08B 21/00

[52] U.S. Cl. ..... 340/237 R; 340/413

[58] Field of Search ..... 340/237 R, 413, 412, 340/151

[56] References Cited

U.S. PATENT DOCUMENTS

| | | | |
|---|---|---|---|
| 3,092,819 | 6/1963 | Cochinal | 340/412 |
| 3,109,929 | 11/1963 | Picard | 340/413 |
| 3,601,806 | 8/1971 | Heimbigner | 340/151 |
| 3,764,983 | 10/1973 | Stok | 340/413 |
| 3,883,868 | 5/1975 | Palmer | 340/151 |
| 3,927,404 | 12/1975 | Cooper | 340/151 |

*Primary Examiner*—Thomas B. Habecker

*Attorney, Agent, or Firm*—Stevens, Davis, Miller & Mosher

[57] ABSTRACT

A centralized monitoring system for gas leakage in which a plurality of remote terminal units are connected by a loop line and each remote terminal units is further connected to one or a plurality of gas leakage detectors which produce analog signals representing the degree of gas concentration. Each remote terminal unit converts the analog signals from the gas leakage detectors into digitally coded block data and then transmit the block data together with an address code in time division fashion to a central monitoring station also connected to the loop line for processing the block data to provide display of the status of the gas concentration at the central station. In the transmission of the data through the loop line, a double transmission check system and a loop line switching means are employed to achieve reliable and fast data transmission.

5 Claims, 3 Drawing Figures

CENTRALIZED MONITORING SYSTEM FOR GAS LEAKAGE

The present invention relates to a centralized monitoring system for gas leakage.

Reference is made to the copending application of Nakamura et al entitled "Monitor and Alarm Apparatus in Loop Line System" Ser. No. 716,557 now abandoned in which the inventors thereof are the joint inventors of the present application and with the copending application assigned to the same assignees as the present application.

The centralized monitoring system is convenient in detecting possible gas leakage at sensing points distributed in an area to be monitored.

In a prior art centralized monitoring system for gas leakage, gas leakage detection circuits distributed in the area to be monitored are radially connected to a central monitor station to separately transmit information on gas leakage to the central monitor station for effecting the centralized monitoring of the gas leakage. The information on the gas leakage may be a signal representing the presence or absence of the gas leakage or a signal representing gas concentration (analog signal).

In the present system, remote terminal units, one for each one or a plurality of gas leakage detection circuits, are branch-connected to a loop line which extends in ring shape from the central monitor station, for collecting and sending the information on any gas leakage to the central monitor station via the loop line. An analog-to-digital converter which is operable independently from a monitor cycle of the central monitor station is provided in each of the remote terminal units so that the analog signals each representing the gas concentration from one or a plurality of gas leakage detection circuits are converted into digital form.

In the present system, in order to reduce the time required for data transmission and to reduce costs per sensing point in the remote terminal unit, the gas leakage detection circuits are grouped with each group comprising a plurality of gas leakage detection circuits, and a batch processing and block data transfer system, is employed. And a buffered processing system of analog-to-digital converted data (in which the remote terminal unit interrupts the processing of analog-to-digital conversion upon receipt of a data transfer instruction from the central monitor station and transfers the data, which have been analog-to-digital converted, as the block data) is adopted to relieve a requirement of processing speed in the analog-to-digital converter.

Since the data at the sensing points are collected through the loop line, appropriate measures are taken in order to prevent errors due to data transmission from being introduced into the system. In the present system, a double transmission check system is used, in which, if there is no complete coincidence between two blocks of data for the same address, data for that address is read again to perform majority decision for the block data.

In the present system, cables to be wired may be shorter than required in the prior art system and hance the cost of wiring can be reduced. At the same time, monitoring density and monitoring capability can be considerably enhanced.

The present invention thus provides a novel centralized monitoring system for the gas leakage as described above.

The present invention is directed to a centralized monitoring system for gas leakage wherein a central monitoring station and a plurality of remote terminal units, one for each one or for a plurality of gas leakage detectors, are connected together via a loop line. A multiplexer and an analog-to-digital converter are provided for each of the remote terminal units to convert detected analog signals from a respective one or a plurality of gas leakage detectors into digitally coded block data. The block data and assigned address codes for each of the remote terminal units are transmitted through the loop line in time division fashion in response to an instruction from the central monitoring station. Furthermore, in the present invention block data are transmitted under a double transmission check system and if there is no complete coincidence between the double transmitted block data, other block data for the same address are read again to perform a majority decision for the block data. In accordance with another feature of the present invention the address code is transmitted from the central monitoring station to the remote terminal units and unless said address code followed by the block data are subsequently transmitted back, transmission/reception cable terminals of the loop line are connected oppositely and said address code is transmitted again.

Preferred embodiments of the present invention will now be described in conjunction with the accompanying drawings, in which:

FIGS. 2 and 3 show detailed block diagrams of the system of FIG. 1, in which FIG. 2 shows a remote terminal unit and FIG. 3 shows a central monitoring station.

In the illustrated embodiment, an address code and a data code for one sensing point are in fixed bit length configuration for the convenience of explanation.

Figure 1:
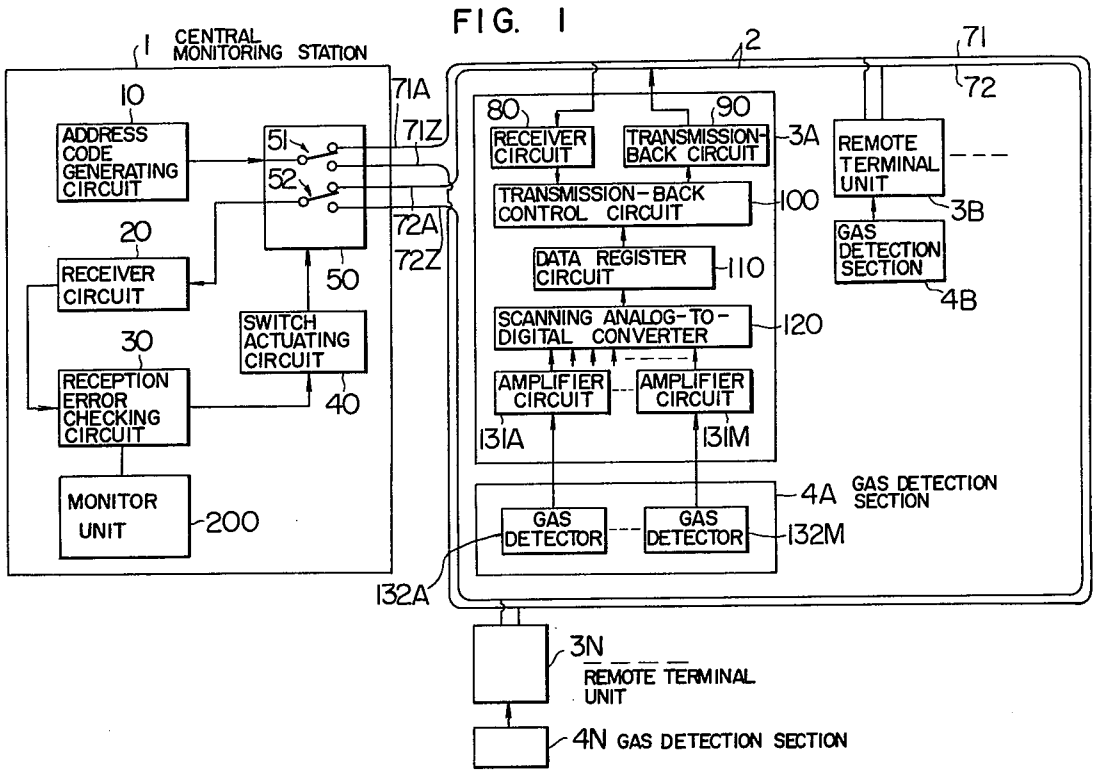
FIG. 1 is a block diagram of one embodiment of the centralized monitoring system for gas leakage according to the present invention.

FIG. 1 shows a block diagram of one embodiment of the present system. The present system generally comprises a central monitoring station 1, a transmission line 2 wired in an area to be monitored for gas leakage, a plurality of remote terminal units 3A, . . . 3N each handling one or a plurality of gas leakage sensing points, and a plurality of gas detectors 4A, . . . 4N each detecting gas. The remote terminal units 3A, . . . 3N may be located respectively at sectors formed in the area.

The central monitoring station 1 includes an address code generating circuit 10 for generating and transmitting address codes, a receiver circuit 20 for receiving address codes and block data transmitted back from the remote terminal units 3A, . . . 3N, a reception error checking circuit 30 for checking the transmitted back address code and block data, a switch-over circuit 50 for switching over the direction of signal current over the transmission line 2, and a switch actuating circuit 40 for actuating the switch-over circuit 50 in response to a result of the reception error check.

The transmission line 2 comprises a twisted pair cable including transmission lines 71 and 72, and is connected with the plurality of remote terminal units 3A, . . . 3N. The transmission lines 71 and 72 form loops with loop ends 71A, 71Z and 72A and 72Z, respectively, which are connected to switches 51 and 52 of the switch-over circuit 50 of the central monitoring station 1.

The remote terminal units 3A, . . . 3N are constructed similarly and hence only the remote terminal unit 3A is described here. It includes a receiver circuit 80 for receiving the address code from the central monitoring station 1, a transmission-back control circuit 100 for detecting the coincidence of the address code for control, a transmission-back circuit 90 for transmitting back the address code of the remote terminal unit 3A and the block data to the central monitoring station 1, a data register circuit 110 for temporarily storing the address code and the block data for transmission-back, amplifier circuits 131A, . . . 131M for amplifying signals from the gas detection section 4A, and a scanning analog-to-digital converter circuit 120 for analog-to-digital converting the signals from the amplifiers 131A, . . . 131M while scanning them.

The gas detection sections 4A, . . . 4N each includes one or a plurality of gas detectors located respectively at detection points. The gas detection section 4A includes, for example, the gas detectors 132A, . . . 132M. An example of a suitable gas detector which may be used is one having a bridge circuit of a platinum wire. The resistance of the bridge circuit is varied depending on the combustion temperature which in turn proportional to the concentration of the gas to be monitored.

Figure 2:
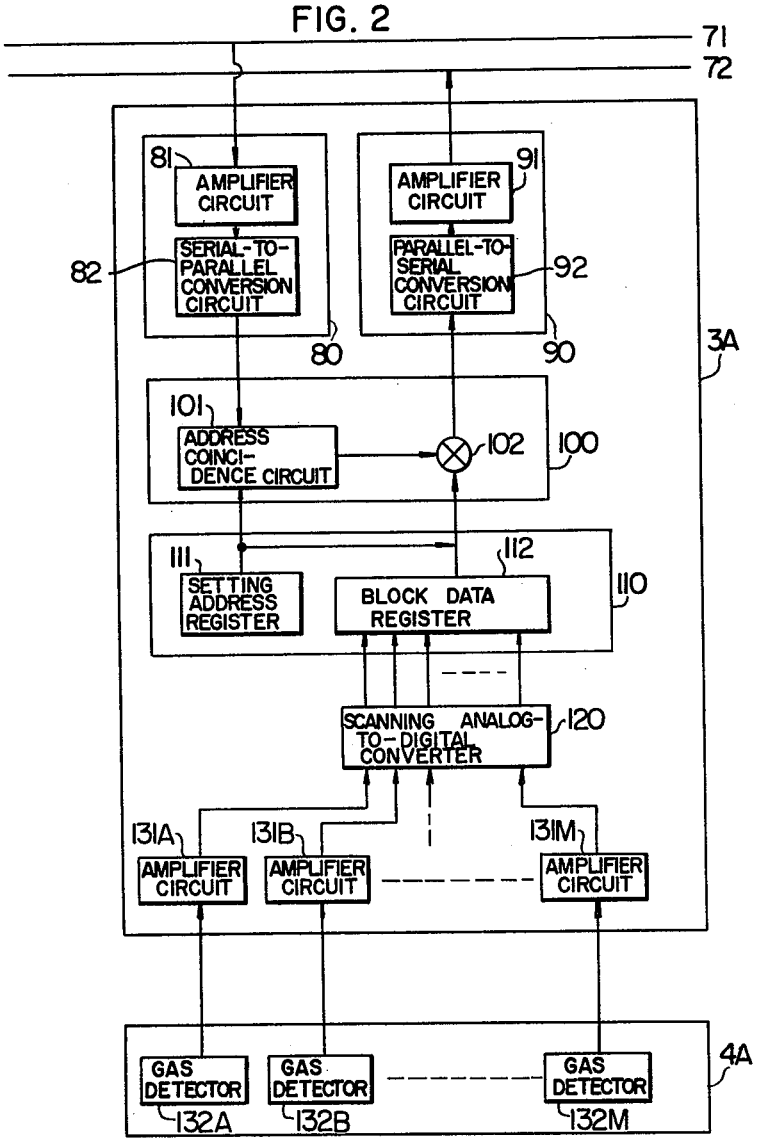
Figure 3:
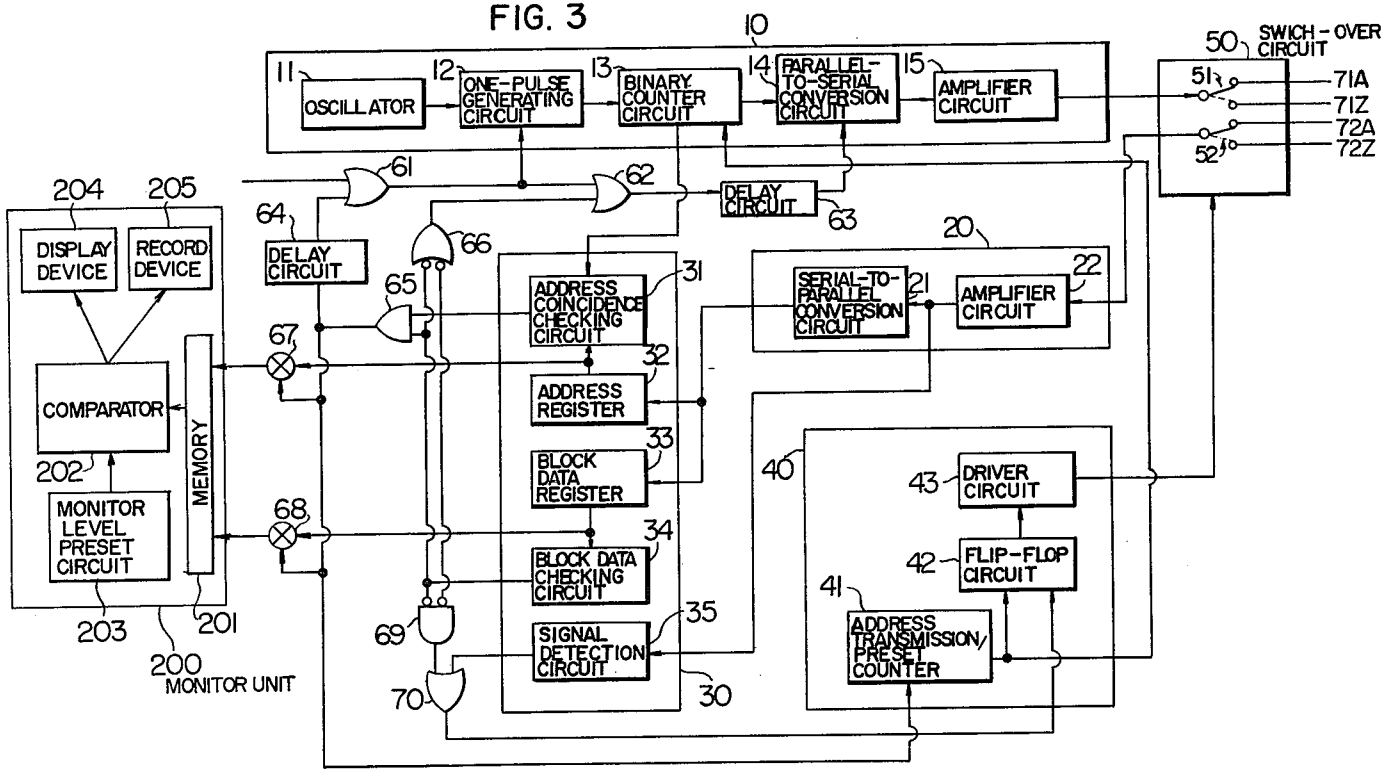

FIGS. 2 and 3 show detailed block diagrams of the present system, in which FIG. 2 illustrates the remote terminal unit and FIG. 3 illustrates the central monitoring station.

Referring now to FIG. 2, the conversion of gas detection information in the illustrated embodiment is explained.

One or a plurality of the gas detectors 132A, . . . 132M of the gas detection section 4A are arranged around the remote terminal unit 3A in the area to be monitored for gas leakage. The detected analog currents, which are proportional to the detected gas concentrations, are fed to amplifier circuits 131A, . . . 131M of the remote terminal unit 3A for amplification. The amplifier circuits 131A, . . . 131M have the functions of zero adjustment and span adjustment for the individual gas detectors 132A, . . . 132M of the gas detection section 4A. Thus, different kinds of detectors may be jointly employed so long as the detectors generate analog current signal in proportion to the concentration of the gas. The amplifier circuits convey the corrected gas concentration signals detected by the gas detectors 132A, . . . 132M to the scanning analog-to-digital converter circuit 120 of the remote terminal unit 3A.

The scanning analog-to-digital converter circuit 120 has a multiplexer for scanning the amplifier circuits 131A, . . . 131M, and the analog signals polled by the multiplexer are converted into digital codes by an analog-to-digital converter circuit.

The scanning analog-to-digital converter continuously performs the analog-to-digital conversion asynchronously with the operation of the transmission-back of the address code and the block data upon reception of the address code from the central monitoring station 1. The digital codes resulting from the analog-to-digital conversion of the analog signals proportional to the gas concentrations detected by the gas detectors 132A, . . . 132M of the gas detection section 4A are serially stored in a block data register 112 of the data register circuit 110 in the remote terminal unit 3A. The content of the block data register 112 is updated for every scanning analog-to-digital conversion.

When the address code is received from the central monitoring station 1, by an addresssed remote station data transfer from its scanning analog-to-digital converter circuit 120 to its data register circuit 110 is interrupted, and the content of the data register 110 is held until the address code and the block data have been transmitted back.

The data register circuits 110 of the remote terminal units 3A, . . . 3N handle the digital codes representing the gas concentrations detected by the gas detectors 132A, . . . 132M of the gas detection section 4A as a series of block data.

The operation of the preferred embodiment of the present invention is now explained with reference to FIGS. 2 and 3.

As an aid to the following description, two logical gates are first defined.

An OR gate 66 performs an OR function when one or both of the two inputs thereto are at low level. An AND gate 69 performs AND function when the two inputs thereto are simultaneously at low level.

A one-pulse generating circuit 12 produces a one-pulse in response to a clock pulse from an oscillator 11 of the address code generating circuit 10 of the central monitoring station 1 and a control signal from the OR gate 61. The one-pulse from the one-pulse generating circuit 12 is counted by a binary counter circuit 13 to produce the address code (in the form of a binary number or BCD number). The address code is passed to a parallel-to-serial conversion circuit 14 and also to an address coincidence checking circuit 31 of the reception error checking circuit 30. The parallel-to-serial conversion circuit 14 converts the address code to a serial signal current in response to a control signal from a delay circuit 63, which is then passed through the amplifier circuit 15 and the switch-over circuit 50 to the loop end 71A of the transmission line 71. The plurality of remote terminal units 3A, . . . 3N connected to the transmission line 71 receive the signal current representing the address code through an amplifier circuit 81 of the receiver circuit 80, and converts it into a parallel address code by a serial-to-parallel conversion circuit 82. The address code preset to a setting address register 111 of the data register circuit 110 is compared with the address code received from the serial-to-parallel conversion circuit 82 by the address coincidence check circuit 101 of the transmission-back control circuit 100, and if the coincidence exists a gate circuit 102 is opened to pass the contents of the setting address register 111 and the block data register 112 to a parallel-to-serial conversion circuit 92, where the address code and the block data are sequentially passed through an amplifier circuit 91 to the transmission line 72.

The signal current representing the address code and the block data passed to the transmission line 72 reaches the loop end 72A of the transmission line 72 and is received by an amplifier circuit 22 of the receiver circuit 20 via the switch-over circuit 50 of the central monitoring station 1. An output from the amplifier circuit 22 is passed to a serial-to-parallel conversion circuit 21 and a signal detection circuit 35 of the reception error checking circuit 30. The address code and the block data transferred to the serial-to-parallel conversion circuit 21 of the receiver circuit 20 are converted into parallel signals and transferred to an address register 32 and a block data register 33, respectively, of the reception error detection circuit 30. The address code stored in the address register 32 is then transferred to the gate circuit 67 and the address coincidence checking circuit 31, and compared with the content of the binary counter circuit 13 of the address generating circuit 10 by the address coincidence checking circuit. If the coincidence occurs a signal is passed to the AND gate 65.

The block data is stored in the block data register 33. The same address code is again transmitted from the address code generating circuit 10, and the address code and the block data from that one of the remote terminal units which corresponds to the transmitted address code are again received. As for the received address code, the coincidence with the transmitted address code is checked, and as for the received block data, the coincidence with the previous block data which has been stored in the block data register 33 is checked. If coincidence occurs the block data is regarded as being correct. If the coincidence does not occur, the address code is again transmitted from the address code generating circuit 10, and the address code and the block data from the corresponding remote terminal unit are received. In this manner the error check for the received data is performed by checking the address code a total of three times and taking a majority decision of two out of the three block data.

In the reception error check, if coincident majority decision is not attained for the three block data for the same address, it is determined that the reception is impossible and that address is skipped.

When the block data checking circuit 34 of the reception error checking circuit 30 determines that the block data is correct, a signal is passed to the AND gate 65. Since the AND gate 65 now meets both requirements from the address coincidence checking circuit 31 and the block data checking circuit 34, it produces an output signal, which in turn causes the gate circuits 67 and 68 to open for permitting transfer of the contents of the address register 32 and the block data register 33 to a monitor unit 200. The monitor unit 200 in this embodiment typically includes a memory 201, comparator 202, monitor level preset circuit 203, display device 204 and record device 205. The block data and the addresses transferred to the monitor unit 200 are stored in the memory 201 in accordance with the address. Then, the stored data is sequentially read out and compared with a predetermined monitor level at the comparator 202. The comparison is conducted for each gas-leakage sensing point as well as each group of the sensing points. The monitor level preset circuit 203 stores data representing the predetermined monitor level. For example, the data may include those representing a high gas-concentration condition, a medium gas-concentration condition and a low gas concentration condition. An output signal from the comparator 202, which represents either one of the three conditions is supplied to the display device 204 and record device 205. The display device 204 may be any type of conventional visual and/or audible device. For instance, where the display device 204 is an electronic display tube having a display screen surface with a map representation of the area, a light (or lamp) or lights are lit at corresponding sensing points on the display screen indicating the status of the gas-leakage condition or the alarm condition for each point. At the same time, the record device 205, including a graph recording device and/or a typewriter, records the time and gas-leakage condition for each sensing point at which the gas-leakage detector is located. The output signal from the AND gate 65 is transferred to an address transmission/preset counter circuit 41 of the switch actuating circuit 40 to count the number of times of the address transmission, and also transferred to a delay circuit 64 the output of which triggers the one-pulse generating circuit 12 of the address generating circuit 10. The above operation is then repeated as the next remote station is addressed. The address transmission/-preset counter circuit 41 of the switch actuating circuit 40 has been preset to the number N of the remote terminal units, and it produces an output signal when the number of address transmissions reaches N to initialize the binary counter circuit 13 of the address code generating circuit 10.

If both of the checks by the address coincidence checking circuit 31 and the block data checking circuit 34 of the reception error checking circuit 30 show errors, the AND gate 69 meets the AND condition and an output signal from the AND gate 69 is passed through the OR gate 70 to set a flip-flop circuit 42 of the switch actuating circuit 40. The flip-flop circuit 42 in turn activates a driver circuit 43 to actuate the switch circuit 50. Switches 51 and 52 in the switching circuit 50 are changed over as shown in a broken line so as to be connected with the loop ends 71Z and 72Z of the transmission lines 71 and 72, repectively.

On the other hand, the parallel-to-serial conversion circuit 14 of the address code generating circuit 10 is controlled through the OR gates, 66, 62 and the delay circuit 63 such that the same address code is re-transmitted to the loop end 72Z of the transmission line 71.

Upon reception of said address code, the remote terminal units 3A, . . . 3N repeat the receiving operation of the receiver circuit 80 and the subsequent operations.

If none of the remote terminal units 3A, . . . 3N corresponding to the address code transmitted from the central monitoring station 1 responds, the signal detection circuit 35 of the reception error checking circuit 30 detects that an output signal from the amplifier circuit 22 of the receiver circuit 20 of the central monitoring station 1 is null. The output signal from the signal detection circuit 35 is passed through the OR gate 70 to set the flip-flop circuit 42 of the switch actuating circuit 40 for activating the driver circuit 43, which causes the switches 51 and 52 of the switching circuit 50 to be changed over to the positions shown in the broken line. The switches 51 and 52 are thus connected to the loop ends 71Z and 72Z of the transmission lines 71 and 72, respectively. On the other hand, the address coincidence checking circuit 31 and the block data checking circuit 34 of the reception error checking circuit 30 generate error indication signals which are passed through the OR gates 66 and 62 and the delay circuit 63 to cause the retransmission of the same address code to the loop end 71Z of the transmission line 71. Upon receipt of said address code, the remote terminal units 3A, . . . 3N repeat the receiving operation of the receiver circuit 80 and the subsequent operations.

The address transmission/preset counter circuit 41 of the switch actuating circuit 40 of the central monitoring station 1 has been preset to the number N of the remote terminal units 3A, . . . 3N, and when the number of times of the address transmissions reaches N, it produces an output signal to reset the flip-flop circuit 42 of the switch actuating circuit 40, which in turn activates the driver circuit 43 to restore the switches 51 and 52 of the switching circuit 50 to the solid line positions.

As described hereinabove, the present system performs the centralized monitoring by connecting the plurality of remote terminal units one for each of one or a plurality of the gas detectors in loop line and scanning them in time division fashion using pulse codes. In order to attain long-term stability and continuous operation for the centralized monitoring station, error prevention means between the central monitoring station and the remote terminal units as well as automatic switching circuit for the loop line are provided.

According to the present system, the number of the sensing points can be readily expanded by merely assigning the address code without requiring substantial change in the system. It is, therefore, most suitable in monitoring a large scale plant.

Furthermore, since the gas concentration signals are collected at the central monitoring station, overall monitoring of the plant is facilitated, and the monitoring capability can be considerably enhanced by dividing the monitoring levels. Accordingly, the application ability of the present system can be remarkably expanded in quality compared with the prior art system.

What is claimed is:

1. A centralized monitoring system for gas leakage comprising:

a plurality of gas leakage detectors disposed in an area, each generating an analog signal representing concentration of the gas at each sensing point, said plurality of gas leakage detectors being formed into a plurality of groups;

a plurality of remote terminal units each connected to a corresponding one of said plurality of groups of gas leakage detectors, each said remote terminal units having a scanning analog-to-digital converter for scanning and converting the analog signals of said group of gas leakage detectors into digitally coded block data signals;

a loop line having a pair of cables for connecting said plurality of remote terminal units in a loop; and a central monitoring station connected to said loop line for receiving said block data signals from each remote terminal unit together with an address code assigned to said remote terminal unit over said loop line on a time division basis in response to an instruction from the central monitoring station, said central monitoring station including a monitor unit for comparing the received block data signals with a predetermined monitoring level and for displaying the status of gas leakage.

2. A centralized monitoring system for gas leakage according to claim 1, wherein said central monitoring station includes an address generating circuit, a block data checking circuit for producing an output signal when two successively supplied block data are coincident, and a gate circuit connected between said address code generating circuit and said block data checking circuit, said gate circuit being controlled by said block data checking circuit such that when said block data checking circuit provides no output signal to said gate circuit when only a first block data is received at said block data checking circuit, said gate circuit provides a signal to said address generating circuit causing it to retransmit said address code to thereby effect a double transmission of said block data.

3. A centralized monitoring system fo gas leakage according to claim 1, wherein said pair of cables contain a first and second pair of terminals located at opposite ends of said pair of cables at said central monitoring station and said central monitoring station further comprises loop line switching means for switching from said first to said second pair of cable terminals of said loop line if the address code of a selected remote terminal followed by its associated block data signals are not subsequently transmitted back from said selected remote terminal after the address code has been transmitted from the central monitoring station, said central monitoring station including means for transmitting said address code again to the corresponding remote terminal unit via said second pair of cable terminals.

4. A centralized monitoring system for gas leakage comprising:

a plurality of gas leakage detectors disposed in an area to be monitored for continuously measuring the concentration of the gas at each sensing point in the area and for generating an analog signal representative thereof, said plurality of gas leakage detectors being grouped into a plurality of groups;

a plurality of remote terminal units each connected to a corresponding one of said plurality of groups of gas leakage detectors, each of said plurality of remote terminal units including, a scanning analog-to-digital converter for continuously scanning the analog signals from said group of gas leakage detectors and for converting the analog signals into digitally coded block data, a data register circuit connected to said scanning analog-to-digital converter for storing said block data which is continuously updated by said scanning analog-to-digital converter, a receiving circuit for receiving an address code, and a transmission circuit for checking the coincidence of the received address code with an assigned address code retained in an address register and for transmitting back the contents of said data register circuit together with the address code when the coincidence of the address is obtained;

a loop line for interconnecting said plurality of remote terminal units in a loop, said loop line having two cables one being connected to said receiving circuit and the other being connected to said transmission circuit in each of said plurality of remote terminal units; and a central monitoring station connected to said loop line, said central monitoring station including, an address code generating circuit having a pulse generator and a counter for generating an address code for each of said plurality of remote terminal units, a reception error checking circuit for checking the coincidence between the address code transmitted back from the remote terminal unit and the address code generated and retained in said address code generating circuit and for checking the coincidence between two successively received block data, said reception error checking circuit generating a coincidence signal separately for each of the coincidence of the address code and the coincidence of the block data, a gate circuit connected to said reception error checking circuit for permitting the address code and the block data to pass therethrough only when the two coincidence signals are received from said reception error checking circuit, a monitor unit connected to said gate circuit for comparing the block data transferred through said gate circuit with a predetermined monitor level for each sensing point as well as each group of sensing points and for displaying and recording the status of the gas-concentration conditions, and a switching circuit for switching between two terminals of each of the transmission and reception cables of said loop line, said switching circuit being connected to said gate circuit and said address code generating circuit and wherein when the coincidence of both the address and the block data is not obtained or when no address and block code are transmitted back to said central monitoring station said switching circuit is actuated by a control signal from said gate circuit to thereby switch between the terminals of the transmission and reception cables.

5. A centralized monitoring system for gas leakage according to claim 1, wherein said scanning analog-to-digital converter in each of said plurality of remote terminal units sequentially scans the analog signals from the group of gas leakage detectors connected thereto and converts the scanned analog signals into said digitally coded block data signals continuously and independently from a monitor operation cycle of said central monitor station.

* * * * *